United States Patent [19]

Kawada et al.

[11] Patent Number: 4,621,597

[45] Date of Patent: Nov. 11, 1986

[54] CYLINDER HEAD FOR DOUBLE OVERHEAD CAM ENGINE

[75] Inventors: Keiichi Kawada, Saitama; Takahiro Okuyama, Tokyo; Susumu Toki, Saitama, all of Japan

[73] Assignee: Honda Giken Kogyo Kabushiki Kaisha, Tokyo, Japan

[21] Appl. No.: 657,338

[22] Filed: Oct. 3, 1984

[30] Foreign Application Priority Data

Oct. 4, 1983 [JP] Japan ..... 58-185249

[51] Int. Cl.[4] ..... F01L 1/04; F01M 1/06

[52] U.S. Cl. ..... 123/90.27; 123/90.34; 123/90.44; 123/193 H

[58] Field of Search ..... 123/90.27, 90.33, 90.34, 123/193 R, 193 H, 90.44

[56] References Cited

U.S. PATENT DOCUMENTS

| | | | |
|---|---|---|---|
| 1,526,678 | 2/1925 | Poppe | 123/90.27 |
| 2,766,739 | 10/1956 | Kosche | 123/90.27 |
| 3,144,013 | 8/1964 | Peras | 123/90.27 |
| 3,352,293 | 11/1967 | Hulten | 123/90.27 |
| 3,722,484 | 3/1973 | Gordini | 123/90.27 |

FOREIGN PATENT DOCUMENTS

| | | | |
|---|---|---|---|
| 2065020 | 12/1971 | Fed. Rep. of Germany | 123/90.44 |
| 296125 | 8/1928 | United Kingdom | 123/90.27 |

*Primary Examiner*—Craig R. Feinberg
*Attorney, Agent, or Firm*—Lyon & Lyon

[57] ABSTRACT

A cylinder head for DOHC type internal combustion engine with a center block integrally formed over each cylinder with portions for supporting the rocker arm bearings and a central hole for receiving the ignition plug. Two main oil supply passages are integrally formed in the head and extending longitudinally on either side of the plug holes for supplying lubricant to the rocker arm bearings and the camshaft bearings on each side.

5 Claims, 7 Drawing Figures

FIG. 5.
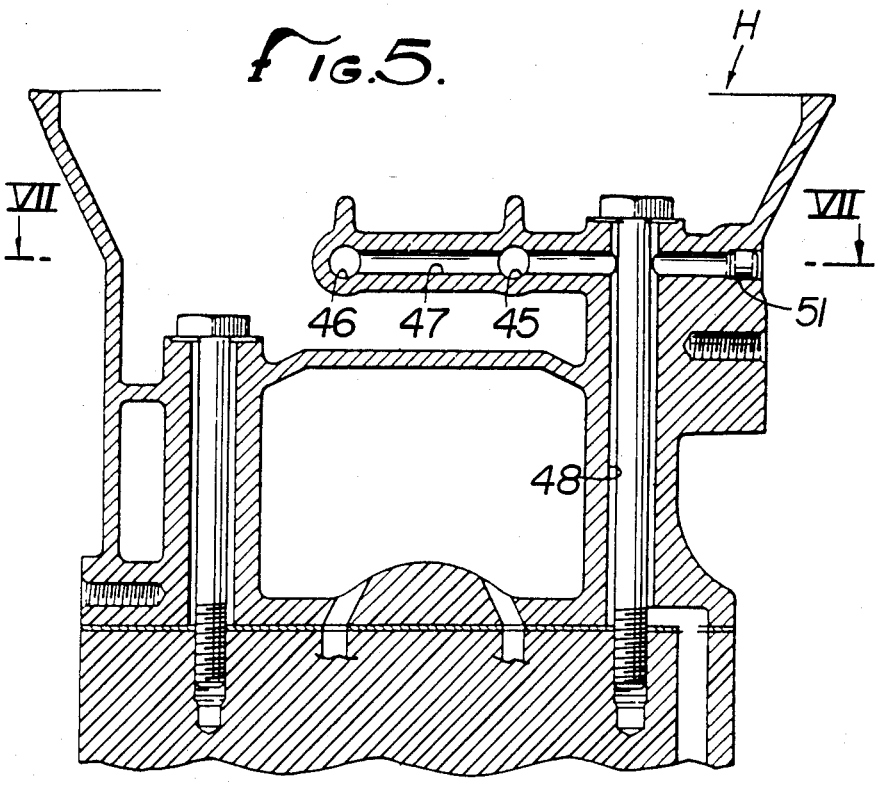
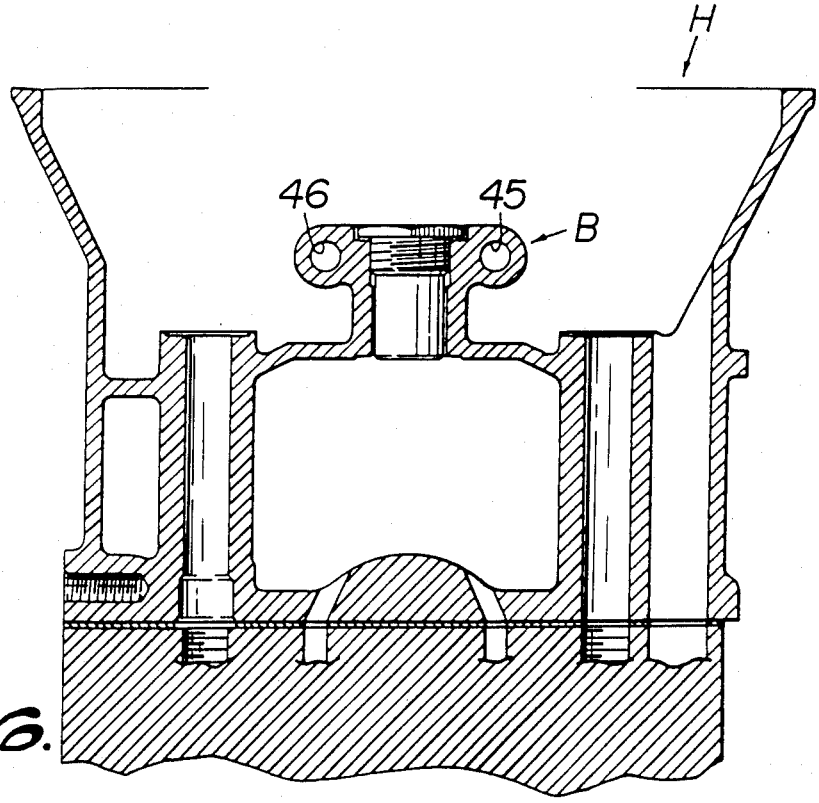
FIG. 6.

CYLINDER HEAD FOR DOUBLE OVERHEAD CAM ENGINE

The present invention relates to a cylinder head for a double overhead cam ("DOHC") type four-cycle internal combustion engine.

In a conventional DOHC type four-cycle internal combustion engine there are valve actuating mechanisms for independently driving the intake valves and exhaust valves by means of two camshafts all provided in the cylinder head which increases the number of the parts of the valve actuating mechanisms mounted in the cylinder head and complicates the construction of the mechanisms so that it enlarges the size of the cylinder head. This is particularly true of the DOHC type four-cycle internal combustion engines in which the actuating motion of the individual valve actuating cams of the two camshafts is transmitted through rocker arms of the end pivot type to the intake and exhaust valves, such as shown in U.S. Pat. Nos. 3,532,080 and 3,722,484, which have the advantage that the adjustment of the valve clearances is facilitated but the disadvantages that the number of parts of the valve actuating mechanisms is further increased to make said mechanisms more complex and heavier. Moreover, the oil supply system for the moving parts of the valve actuating mechanisms is complicated to further increase the size and weight of the cylinder head.

It is, therefore, an object of the present invention to provide a cylinder head for a DOHC type internal combustion engine, which is of less size and weight than prior art arrangements without any loss in strength.

In order to achieve the above-specified object, the cylinder head for a DOHC type four-cycle internal combustion engine according to the present invention is comprised of a center block is integrally formed between the bearing portions for the intake and exhaust camshafts with a plug fitting cylinder and hole for receiving the ignition plug therein, intake and exhaust rocker arm bearing support portions formed at both the sides of the plug fitting holes, and a pair of main oil supply passages formed in the longitudinal direction of the crankshaft at both the sides of the plug fitting holes for supplying oil to the bearing portions of the intake and exhaust camshafts and the rocker arm bearing support portions.

The present invention will be described in the following with reference to the accompanying drawings illustrating a DOHC type four-valve, four-cylinder and fourcycle internal combustion engine but it will be understood by those skilled in the art that the invention may be used with engines having more or fewer valves and cylinders.

FIG. 5 is a sectional elevation view taken substantially on the line V—V in FIG. 2.

FIG. 6 is a sectional elevation view taken substantially on the line VI—VI in FIG. 1.

As shown in FIGS. 1 to 4, four combustion chambers 1 corresponding to individual cylinders are formed in the bottom of a rectangular cylinder head H in a line along the direction of a longitudinal axis $L_1$—$L_1$, i.e., the axis of the crankshaft. Those combustion chambers 1 have their lower openings facing the heads of pistons which are fitted in cylinders of a cylinder block in a conventional manner, which is not shown.

Figure 3:
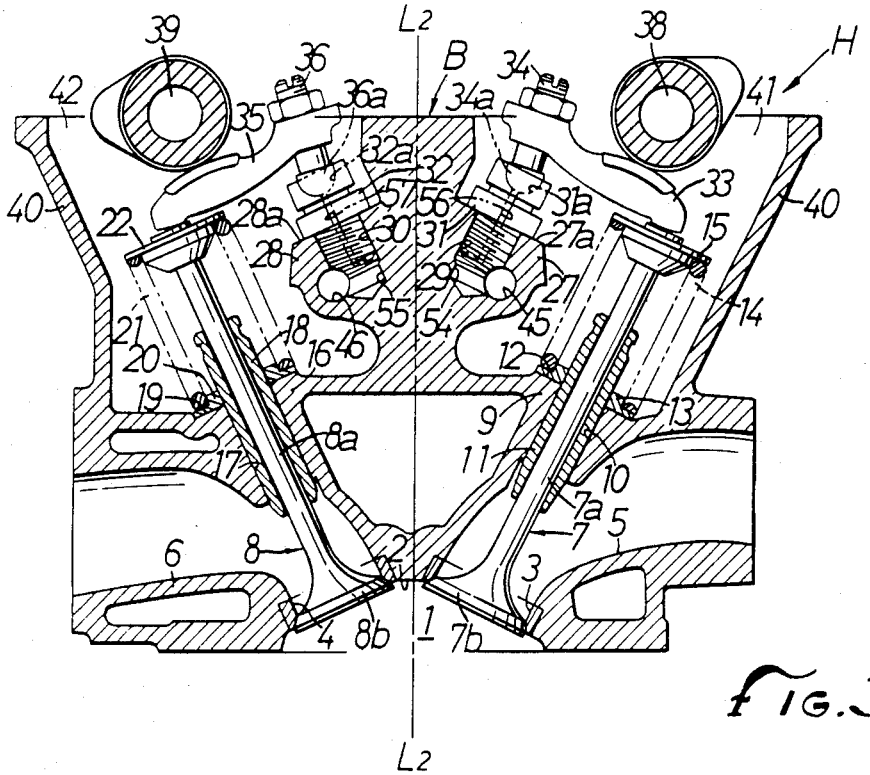
FIG. 3 is a sectional elevation view of valves and actuating mechanisms, with portions shown in elevation, taken substantially on the line III—III in FIG. 2.
Figure 4:
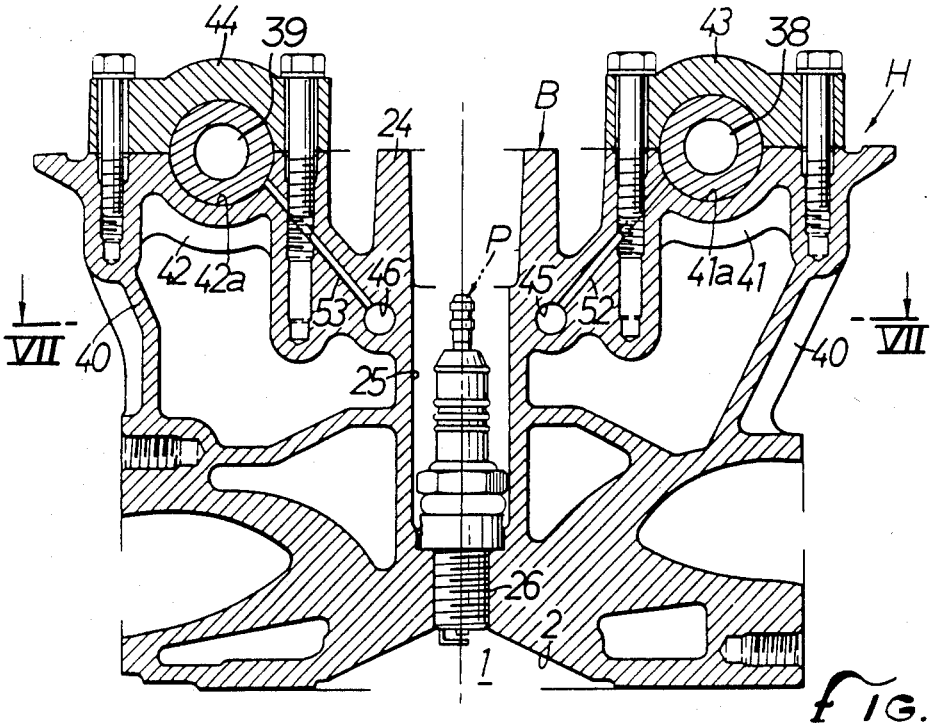
FIG. 4 is a sectional elevation view taken substantially on the line IV—IV in FIG. 2.
Figure 7:
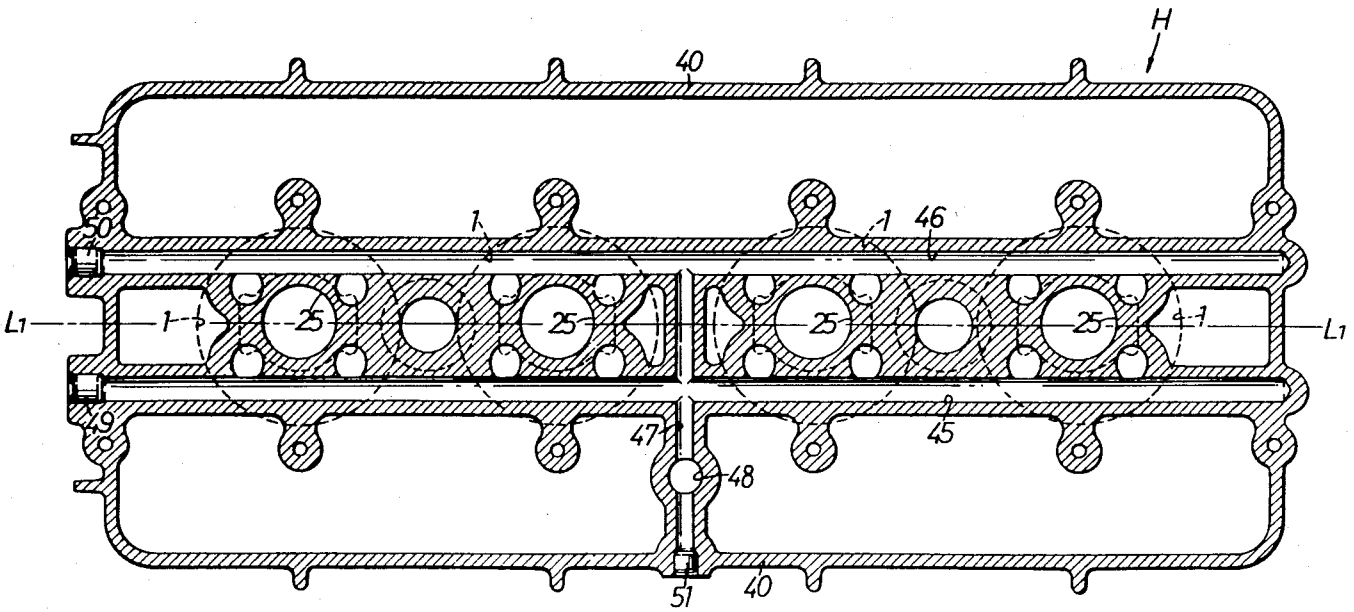
FIG. 7 is a sectional plan view taken substantially on the line VII—VII in FIG. 5.

At one side of a ceiling wall 2 of longitudinally angular section of each combustion chamber 1, as shown in FIGS. 3 and 4, there are opened two intake valve ports 3 and 3 which are aligned with each other in the crankshaft direction. At the other side of the aforementioned ceiling wall 2, there are opened two exhaust valve ports 4 and 4 which are aligned with each other in the crankshaft direction. The two intake valve ports 3 and 3 and the two exhaust valve ports 4 and 4 are arranged symmetrically of each other with respect to a cylinder center line $L_2$—$L_2$. Each intake valve port 3 communicates with an intake port 5 which extends transversely of the cylinder head H until it opens in one side face (as located at the righthand side of FIG. 3) of said head H. Each exhaust valve port 4 communicates with an exhaust port 6 which extends transversely of the cylinder head H in the opposite direction until it opens in the other side face (as located at the lefthand side of FIG. 3) of said head H. Each intake port 5 is formed at its upper wall with a valve supporting portion 9 which is used to support an intake valve 7 for opening and closing the aforementioned intake valve port 3. In the valve supporting portion 9, there is formed a valve receiving hole 10 in which a guide sleeve 11 is press-fitted. The intake valve 7 has its stem 7*a* fitted slidably in guide sleeve 11 from the combustion chamber side such that its poppet valve member 7*b* is seated on the aforementioned intake valve port 3. The valve supporting portion 9 is formed with a spring seat 12 on which a lower spring seat 13 is positioned and engaged by a valve spring 14 surrounding the aforementioned stem 7*a*. The valve spring 14 has its upper face seated upon an upper spring seat 15, which is retained on the upper end of the aforementioned stem 7*a*, so that the aforementioned valve spring 14 biases the intake valve 7 in the closed direction thereof.

Likewise, each exhaust port 6 is formed at its upper wall with the exhaust valve supporting portion 16 which is used to support an exhaust valve 8 for opening and closing the exhaust valve port 4. In the valve supporting portion 16, there is formed a valve receiving hole 17 in which a guide sleeve 18 is press-fitted. The exhaust valve 8 has its valve stem 8*a* fitted slidably in guide sleeve 18 from the combustion chamber side such that its poppet valve member 8*b* is seated on the aforementioned exhaust valve port 4. The valve supporting portion 16 is formed with a spring seat 19 on which a lower spring seat 20 is positioned and engaged by a valve spring 21 surrounding the aforementioned stem 8*a*. The valve spring 21 has its upper face seated upon an upper spring seat 22, which is retained on the upper end of the aforementioned stem 8*a*, so that the aforementioned valve spring 21 biases the exhaust valve 8 in the closed direction thereof.

As shown in FIGS. 1 to 4, a center block portion B of cylinder head H is provided to extend upright integrally on each of the aforementioned combustion chambers 1 in the longitudinal direction of the crankshaft. The center block B is formed above the centers of the individual combustion chambers 1 with hollow plug fitting cylinders 24 which project straight upward. Each plug fitting cylinder 24 is formed with a plug receiving hole 25 which has its upper end opened. The plug receiving hole 25 has its bottom communicating with the corresponding combustion chamber 1 through a threaded hole 26 which is formed in the upper wall of that combustion chamber 1. An ignition plug P is inserted into each plug receiving hole 25 and is fitted in the cylinder head H by having its threaded portion engaged in the threaded hole 26.

Figure 1:
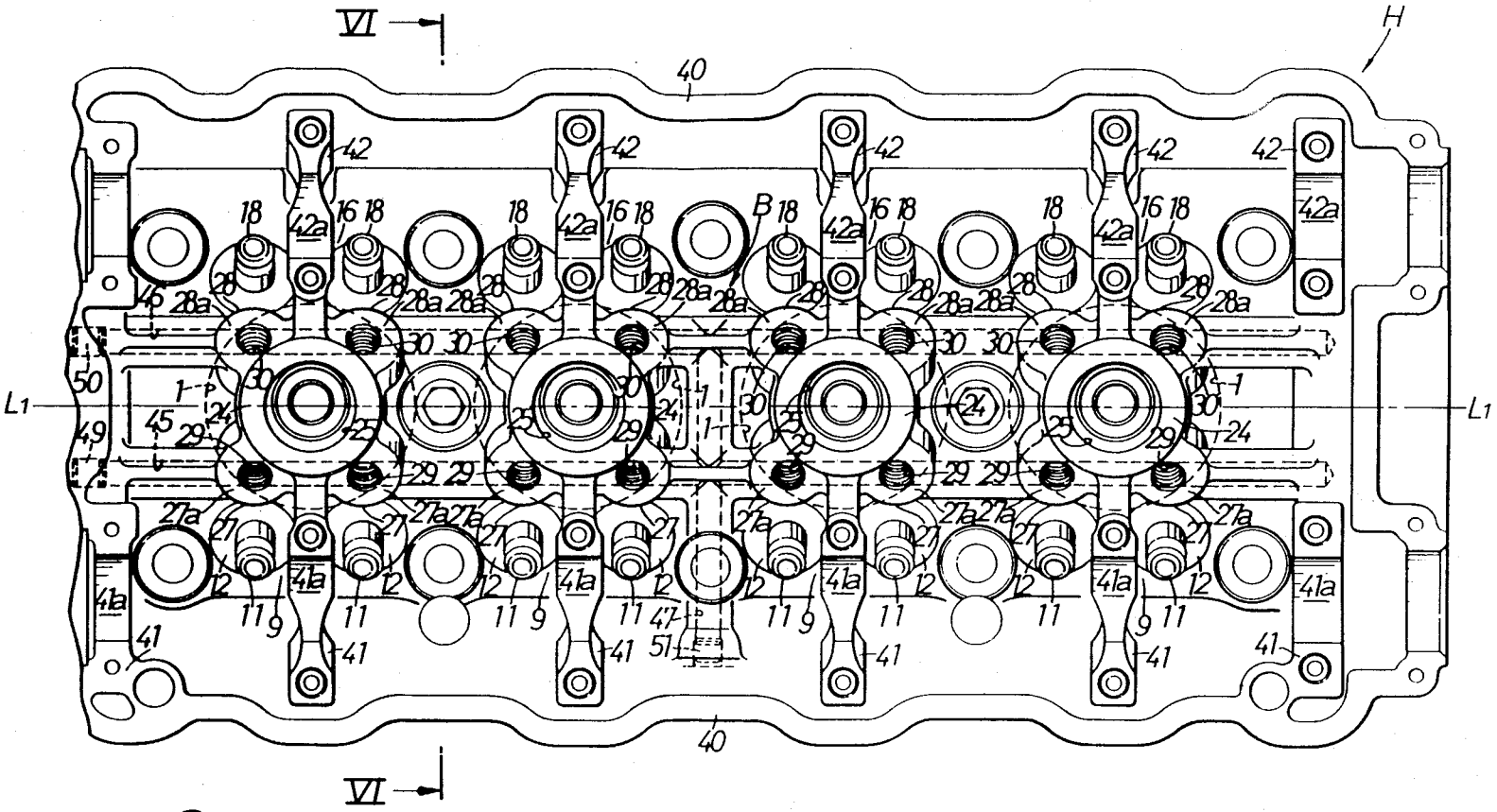
FIG. 1 is a top plan view of the cylinder head of this invention with the camshafts and valve actuating mechanisms removed for clarity of illustration.
Figure 2:
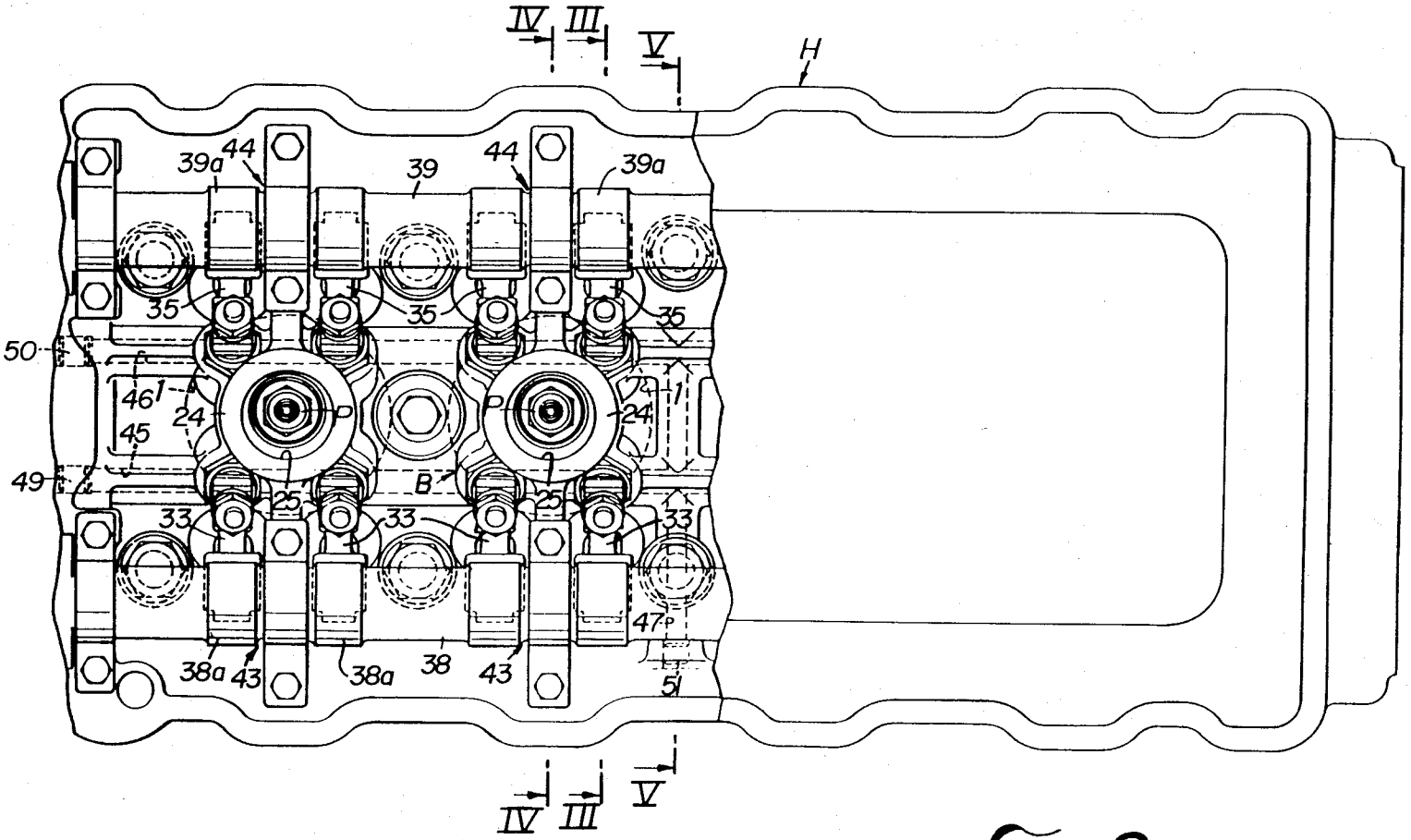
FIG. 2 is a top plan view similar to FIG. 1 but with the camshafts and valve actuating mechanisms installed.

At both sides of each plug fitting cylinder, as shown in FIGS. 1 to 3, bulging portions are integrally formed in center block B for two intake valve side rocker arm support portions 27, which correspond to the aforementioned two intake valves 7, and for two exhaust valve side rocker arm supporting portions 28 which correspond to the two exhaust valves 8. Those support portions 27 and 28 have their upper faces formed into sloped flat seats 27*a* and 28*a* which are inclined downwardly toward the outside. The aforementioned rocker arm support portions 27 and 28 are formed with threaded holes 29 and 30, respectively, in which rocker arm supporting members 31 and 32 are threadly fastened. Each intake valve side rocker arm supporting member 31 is formed on its upper face with a spherical bearing portion 31*a*. The spherical bearing portion 31*a* is engaged by an articulated spherical projection 34*a* formed at the lower end of adjusting screw 34 which is fastened to the base end of end pivot type rocker arm 33. Each intake side rocker arm 33 has its leading end abutting against the upper end of the stem 7*a* of the intake valve 7. Likewise, each exhaust side rocker arm supporting member 32 is formed with a spherical bearing portion 32*a* which engages the spherical projection 36*a* formed at the lower end of an adjusting screw 36 fastened to the base end of an end pivot type rocker arm 35. This exhaust side rocker arm 35 has its leading end abutting against the upper end of the stem 8*a* of the exhaust valve 8.

Between the sides of the aforementioned center block B and the outer walls 40 of the cylinder head, as shown in FIGS. 1 and 4, there are interposed a plurality of camshaft supporting walls 41 and 42 which are spaced in the longitudinal crankshaft direction and extended transversely. The supporting walls 41 on one side are formed thereon with semicircular bearing portions 41*a* for supporting the intake side camshaft 38, whereas the supporting walls 42 on the other side are formed thereon with semicircular bearing portions 42*a* for supporting the exhaust side camshaft 39.

The intake side camshaft 38 is rotatably borne between the aforementioned one-side bearing portions 41*a* and bearing caps 43 mounted on the upper faces of the former. Similarly, the exhaust side camshaft 39 is rotatably borne between the other side bearing portions 42*a* and bearing caps 44 mounted on the upper faces of the former.

As shown in the figures, the cylinder head H is formed therein with a pair of main oil supply passages 45 and 46 which extend therethrough in the longitudinal direction of the center block B, i.e., in the crankshaft direction and intersect a communication oil passage 47 extending across the central portions thereof (see FIGS. 5 and 6). This communication oil passage 47 is made to communicate with an oil feed passage 48 which extends vertically in the cylinder head H to communicate with a not-shown oil pump. The open ends of the aforementioned paired main oil supply passages 45 and 46 and communication oil passage 47, which are formed in the outer faces of the cylinder head H, are sealed with blind plugs 49, 50 and 51, respectively.

From the main oil supply passages 45 and 46, as shown in FIG. 4, there are a plurality of branch oil passages 52 and 53 of which the one-side branch oil passsages 52 open into the bearing faces of the intake side bearing portions 41*a*, whereas the otherside branch oil passages 53 open into the exhaust side bearing portions 42*a*.

As shown in FIG. 3, the paired main supply passages 45 and 46 directly communicate with oil sumps 54 and 55 which are formed in the lower portions of the plural intake and exhaust side threaded holes 29 and 30, respectively. Those oil sumps 54 and 55 communicate with the bearing portions 31*a* and 32*a* of the intake and exhaust side rocker arms 33 and 35 by way of oil passages 56 and 57 which are formed in the rocker arm supporting members 31 and 32, all respectively.

When the intake and exhaust side camshafts 38 and 39 rotate during running of the engine, the intake and exhaust side rocker arms 33 and 35 are vertically rocked to open and close the intake and exhaust valves 7 and 8, respectively, at predetermined timings. The lubricating oil from the oil pump is distributed and supplied via the oil feed passage 48 and the communication oil passage 47 to the paired main oil supply passages 45 and 46, from which it is supplied through the branch oil passages 52 and 53 to the bearing portions 41*a* and 42*a* of the intake and exhaust camshafts 38 and 39 and through the oil sumps 54 and 55 and the oil passages 56 and 57 to the bearing portions 31*a* and 32*a* of the intake and exhaust rocker arms 33 and 35.

As has been described hereinbefore, according to the present invention, there is provided a cylinder head for a DOHC type four-cycle internal combustion engine with a center block extending longitudinally above the combustion chambers between the bearing portions of the intake and exhaust camshafts formed with a plug fitting cylinder for fitting an ignition plug therein, intake and exhaust rocker arm bearing support portions formed at both the sides of the plug fitting cylinder, and a pair of main oil supply passages formed in the direction of a crankshaft at both sides of the plug fitting cylinder for supplying oil to the bearing portions of said intake and exhaust camshafts and the rocker arm bearing support portions. As a result, the ignition plugs, the rocker arm bearing support portions and the paired main oil supply passages are concentrated at the aforementioned center block, and the valve actuating mechanisms including the aforementioned rocker arm bearing portions are interposed between the center block and the two camshafts. Since the center block is reinforced longitudinally by the portions forming the paired main oil supply passages, moreover, at least its portion can be thinned so that the cylinder head size and weight is minimized. Still, moreover, the bearing portions of the rocker arms and the camshafts are supplied with the lubricant by the paired main oil supply passages, the oil supply circuit is simplified.

The invention claimed is:

1. A cylinder head for a DOHC type four-cycle internal combustion engine that for each cylinder of a plurality of cylinders has a combustion chamber with intake and exhaust valve ports opened therein, intake and exhaust ports communicating with said valve ports, valve supporting portions supporting in a slidable manner, the intake and exhaust valves for opening said intake and exhaust valve ports, said cylinder head having a predetermined length substantially that of said engine along its longitudinal axis, and bearing portions rotatably supporting two camshafts of valve actuating mechanisms for opening and closing said intake and exhaust valves, the improvement comprising, a center block integrally formed in the cylinder head to extend the entire length of the cylinder head above each said combustion chamber and located between the bearing portions for the intake and exhaust camshafts, said center block formed in its center axis with a plug fitting cylinder for receiving an ignition plug at each engine cylinder, said center block formed with intake and exhaust rocker arm bearing support portions on both lateral sides of said plug fitting cylinder, a pair of main oil supply passages formed in the longitudinal direction of the engine crankshaft on both lateral sides of said plug fitting cylinder, and means formed in said center block communicating each said main oil supply passage with said rocker arm bearing support portions and camshaft bearing portions on that lateral side for lubricating said rocker arm bearing portions and camshaft bearing portions, said camshaft bearing portions being integrally formed with and connected to each center block along a top surface thereof.

2. The cylinder head of claim 1 wherein said means communicating said main passages with said rocker arm bearing support portion comprises a bore in each said rocker arm bearing support portion for receiving the rocker arm bearing and which bore intersects said main passage.

3. The cylinder head of claim 1 wherein longitudinally extending flat integral portions of said cylinder head are formed with said main oil supply passages and connect and reinforce said center blocks of each cylinder.

4. A cylinder head for a DOHC type four-cycle internal combustion engine that for each cylinder of a plurality of cylinders has a combustion chamber with intake and exhaust valve ports opened therein, intake and exhaust ports communicating with said valve ports, valve supporting portions supporting in a slideable manner, the intake and exhaust valves for opening said intake and exhaust valve ports, said cylinder head having a predetermined length substantially that of said engine along its longitudinal axis, and bearing portions rotatably supporting two camshafts of valve activating mechanisms for opening and closing said intake and exhaust valves, the improvement, comprising, a center block integrally formed in the cylinder head to extend the entire length of the cylinder head above each said combustion chamber and located between the bearing portions for the intake and exhaust camshafts, said center block formed in its center axis with a plug fitting cylinder for receiving an ignition plug at each engine cylinder, said center block integrally formed with intake and exhaust rocker arm bearing support portions on both lateral sides of said plug fitting cylinder, said center block integrally formed along a top surface thereof with camshaft supporting walls having the camshaft bearing portions, said camshaft supporting walls spaced in the longitudinal direction of the engine and extending from the center block transversely at the center of each engine cylinder between said valves and said rocker arm bearing portions of that engine cylinder, longitudinally extending flat integral portions of said cylinder head being formed with a pair of main oil supply passages formed in the longitudinal direction of the engine crankshaft on both lateral sides of said plug fitting cylinders, and means formed in said center block communicating each said main oil supply passage with said rocker arm bearing support portions and camshaft bearing portions on that lateral side for lubricating said rocker arm bearing portions and camshaft portions.

5. The cylinder head of claim 4 wherein said means communicating said main passages with said rocker arm bearing support portion comprises a bore in each rocker arm bearing support portion for receiving the rocker arm bearing and which bore intersects said main passage.

* * * * *